US009145531B2

(12) United States Patent
Delbridge et al.

(10) Patent No.: US 9,145,531 B2
(45) Date of Patent: Sep. 29, 2015

(54) AMINE TERMINATED AND HYDROXYL TERMINATED POLYETHER DISPERSANTS

(71) Applicant: The Lubrizol Corporation, Wickliffe, OH (US)

(72) Inventors: Ewan E. Delbridge, Concord Township, OH (US); Renee A. Eveland, Concord Township, OH (US); Joanne L. Jones, Nottingham (GB); John K. Pudelski, Cleveland Hts., OH (US); Nicolas Proust, Willoughby, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 263 days.

(21) Appl. No.: 13/858,316

(22) Filed: Apr. 8, 2013

(65) Prior Publication Data

US 2013/0274160 A1 Oct. 17, 2013

Related U.S. Application Data

(60) Provisional application No. 61/622,753, filed on Apr. 11, 2012.

(51) Int. Cl.

| | |
|---|---|
| ***C10M 149/12*** | (2006.01) |
| ***C10M 159/12*** | (2006.01) |
| ***C10M 145/24*** | (2006.01) |
| ***C10M 149/14*** | (2006.01) |
| ***C10M 159/00*** | (2006.01) |

(52) U.S. Cl.

CPC ..... *C10M 149/12* (2013.01); *C10M 145/24* (2013.01); *C10M 149/14* (2013.01); *C10M 159/005* (2013.01); *C10M 159/12* (2013.01); *C10M 2207/34* (2013.01); *C10M 2209/082* (2013.01); *C10M 2209/086* (2013.01); *C10M 2209/104* (2013.01); *C10M 2209/106* (2013.01); *C10M 2209/107* (2013.01); *C10M 2209/109* (2013.01); *C10M 2215/02* (2013.01); *C10M 2215/042* (2013.01); *C10M 2215/06* (2013.01); *C10M 2215/26* (2013.01); *C10M 2217/04* (2013.01); *C10M 2217/041* (2013.01); *C10M 2217/06* (2013.01); *C10N 2230/04* (2013.01); *C10N 2230/10* (2013.01); *C10N 2230/36* (2013.01); *C10N 2230/52* (2013.01); *C10N 2240/10* (2013.01); *C10N 2240/102* (2013.01); *C10N 2240/104* (2013.01); *C10N 2240/12* (2013.01)

(58) Field of Classification Search

USPC ..... 508/287, 556; 564/326

See application file for complete search history.

(56) References Cited

U.S. PATENT DOCUMENTS

| | | | | |
|---|---|---|---|---|
| 3,219,666 | A * | 11/1965 | Norman et al. | 544/383 |
| 3,957,854 | A * | 5/1976 | Miller | 560/168 |
| 5,422,024 | A * | 6/1995 | Vickerman et al. | 508/506 |
| 7,816,309 | B2 | 10/2010 | Stokes et al. | |
| 7,820,604 | B2 | 10/2010 | Ruhe, Jr. et al. | |
| 7,820,605 | B2 | 10/2010 | Stokes et al. | |
| 7,858,566 | B2 | 12/2010 | Ruhe, Jr. et al. | |
| 7,928,044 | B2 | 4/2011 | Stokes et al. | |
| 8,067,341 | B2 | 11/2011 | Jung et al. | |
| 2009/0270531 | A1 * | 10/2009 | Ruhe, Jr. | 523/149 |

FOREIGN PATENT DOCUMENTS

WO 2011/022317 A1 2/2011

* cited by examiner

*Primary Examiner* — James Goloboy

(74) *Attorney, Agent, or Firm* — Christopher P. Demas

(57) ABSTRACT

The disclosed technology relates to a dispersant composition comprising the reaction product of a polyolefin acylating agent and an amine terminated or hydroxyl terminated polyether. In addition, the technology relates to lubricating compositions containing the dispersant composition and an optional synergistic amount of another dispersant, as well as methods of employing the dispersant composition in an engine and engine oils.

15 Claims, No Drawings

AMINE TERMINATED AND HYDROXYL TERMINATED POLYETHER DISPERSANTS

BACKGROUND OF THE INVENTION

The disclosed technology relates to a dispersant composition comprising the reaction product of a polyolefin acylating agent and an amine terminated or hydroxyl terminated polyether. In addition, the technology relates to lubricating compositions containing the dispersant composition and an optional synergistic amount of another dispersant, as well as methods of employing the dispersant composition in an engine and engine oils.

Deposit formation resulting from the thermal stressing of engine oil formulations is a growing concern, especially when considering that engines are being designed to be more fuel efficient. Efficiency improving measures are being accomplished, for example, by driving towards smaller sump sizes, turbocharging, and implementing gasoline direct injection (GDI). These efficiency measures impart greater thermal stress to the engine oil formulations used to lubricate the engine. The greater the thermal stress the formulations experience, the increased propensity of the formulation towards deposits, with the net result being loss in engine efficiency and overall life-expectancy.

Additionally, ever-restricting emissions regulations that invariably curb the use of ash-bearing deposit controlling components (because they can irreversibly poison after treatment devices) amplify the formulating challenges to build robust lubricants with low deposit propensity.

Typically, deposits are curbed with high molecular weight polyamine succinimide dispersants of, for example, greater than 20,000 Da. While amine terminated and hydroxyl terminated polyethers can be employed in engine oil formulations to reduce white sludge propensity, the incorporation of such polyethers into dispersant frameworks as a means to reduce the formation of thermally induced deposits, oxidation, and nitration, as well as facilitate TBN retention and seals amelioration has not been considered.

WO 2011/022317, published Feb. 24, 2011 to Barton et al., teaches, among other things, the reaction product of an acid, such as glycolic acid or lactic acid, with an amine, an alcohol, and an aminoalcohol. The low molecular weight, highly polar compositions formed are taught to act as antiwear agents.

A string of publications, including U.S. Pat. No. 7,816,309, issued Oct. 19, 2010, U.S. Pat. No. 7,820,605, issued Oct. 26, 2010, U.S. Pat. No. 7,928,044 issued Apr. 19, 2011 to Stokes et al., and U.S. Pat. No. 7,820,604 issued Oct. 26, 2010, U.S. Pat. No. 7,858,566 issued Dec. 28, 2010, U.S. Pat. No. 8,067,341 issued Nov. 29, 2011 to Ruhe Jr. et al., and U.S. 2009/0270531 published Oct. 29, 2009 to Ruhe, Jr., teach variations of compositions comprised of at least the reaction product of (A) at least one copolymer obtained by free radical copolymerization, and (B) at least one amine terminated ether compound, along with optional further compounds. New dispersant technology is needed.

SUMMARY OF THE INVENTION

The inventors have now discovered dispersant compositions with improved performance properties.

The disclosed technology provides a dispersant composition. The dispersant composition comprises the reaction product of a polyolefin acylating agent and a hydroxyl terminated or amine terminated polyether.

The hydroxyl terminated or amine terminated polyether can be selected from the group consisting of (i) a polyethylene glycol, (ii) a polypropylene glycol, (iii) a mixture of polyoxyalkylene amines, or (iv) some combination thereof. The hydroxyl terminated or amine terminated polyether can also be selected from the group consisting of (i) triethylene glycol, (ii) diethylene glycol, (iii) a 250 to 350 molecular weight polyethylene glycol, (iv) a 200 to 350 molecular weight polytetrahydrofuran, (v) a mixture of one or more amine terminated glycols containing units derived from ethylene oxides, propylene oxides, butylene oxides or some combination thereof, or (vi) some combination thereof.

In one embodiment, the polyether in the dispersant composition can comprise units derived from Formula I:

Formula I

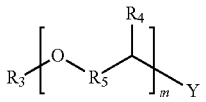

wherein:

$R_3$ can be hydrogen (H), —$R_6$OH, —$R_6NH_2$, —(C═O)$R_6$, —$R_6$—N(H)C(═O)$R_6$, or a hydrocarbyl group of from 1 to 30 carbon atoms, $R_4$ can be H, or a hydrocarbyl group of from 1 to 10 carbon atoms, $R_5$ can be a straight or branched hydrocarbyl group of from 1 to 6 carbon atoms, $R_6$ can be a hydrocarbyl group of 1 to 20 carbon atoms, Y can be $NR_7R_8$, OH, $R_6NH_2$ or $R_6$OH, $R_7$, and $R_8$, independently, can be H, or a hydrocarbyl group of from 1 to 50 carbon atoms in which up to one third of the carbon atoms can be substituted by N or functionalized with additional polyether of Formula I, and m can be an integer from 1 to 30.

In another embodiment, there is provided a lubricant composition comprised of the dispersant composition and an oil of lubricating viscosity. In a similar embodiment, the lubricant composition can further comprise a poly(isobutylene) (PIB) succinimide.

In further embodiments, there is provided a method of improving deposit performance in an engine, or improving seal performance in an engine, comprising applying to the engine the dispersant composition or lubricant composition containing the dispersant composition.

In still further embodiments, there is provided a method of improving nitration and oxidation performance in an engine oil, and maintaining TBN in an engine oil, comprising applying to the engine the dispersant composition or lubricant composition containing the dispersant composition.

In another embodiment, the methods described can further comprise applying to the engine oil a PIB Succinimide.

DETAILED DESCRIPTION OF THE INVENTION

Various preferred features and embodiments will be described below by way of non-limiting illustration.

One aspect of the invention is a dispersant composition comprising the reaction product of a polyolefin acylating agent, and a hydroxyl terminated or amine terminated polyether.

Acylating agents are compounds that can provide an acyl group in an acylation reaction. Useful acylating agents, or unsaturated carboxylic reactants, generally are carboxylic acids, such as monoethylenically unsaturated $C_3$-$C_{28}$ monocarboxylic acids or esters thereof, or monoethylenically unsaturated $C_4$-$C_{28}$ dicarboxylic acids, anhydrides or esters thereof. Typical examples of acylating agents are, for example, maleic acid, itaconic acid, fumaric acid, cinnamic acid, (meth)acrylic acid, and reactive equivalents and derivatives, such as anhydrides or esters, thereof. A polyolefin acylating agent is a polyolefin functionalized with at least one acylating agent.

Polyolefins can be homopolymers or copolymers. Polyolefins can be, for example, conventional polyolefins, such as conventional polyisobutylene (PIB), high vinylidene PIB, and olefin copolymers, such as an ethylene-propylene copolymer.

In one embodiment, the polyolefin can be a conventional polyolefin. Conventional polyolefins are derived from polymerized $C_2$-$C_6$ mono olefins. The polymers may be homopolymers, copolymers or interpolymers. The preferred polyolefin is PIB formed by polymerizing the $C_4$—raffinate of a cat cracker or ethylene plant butane/butene stream using aluminum chloride or other acid catalyst systems.

A polyolefin made using aluminum chloride in the foregoing manner is termed a conventional PIB and is characterized by having unsaturated end groups shown in Table 1 with estimates of their mole percents based on moles of polyisobutylenes. The structures are as shown in EPO 355 895. Conventional PIBs are available commercially under numerous trade names including Parapol® from Exxon and Lubrizol® 3104 from Lubrizol.

TABLE 1

| PIB Terminal Groups | (a) Typical Percent in Conventional PIB | (b) Typical Percent in High Vinylidene PIB |
|---|---|---|
| 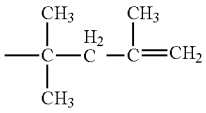 I | 4-5% | 50-90% |
| 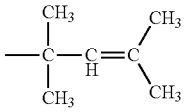 II | 0-2% | 6-35% |
| 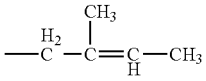 III | 63-67% tri-substituted | absent or minor |
| 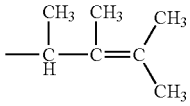 IV | 22-28% tetrasubstituted | 1-15% |
| 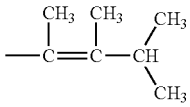 IV | IV and IVa | |
| 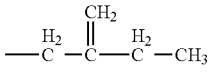 V | 5-8% | 0-4% |
| OTHER | 0-10% | |

The polyolefin may also be a high vinylidene polyolefin, such as a high vinylidene PIB. As shown in Table 1, a high vinylidene PIB can be characterized as having a major amount, typically more than 50 mol/% of an alpha-vinylidene, often referred to as methylvinylidene, and/or beta-double bond isomer (respectively —$CH_2C(CH_3)$=$CH_2$ and/or —CH=$C(CH_3)_2$), and minor amounts of other isomers including a tetrasubstituted double bond isomer. High vinylidene PIBs generally can contain greater than about 50 mole %, 60 mole %, or 70 mole % or greater and usually about 80 mole % or greater or 90 mole % or greater of alpha-vinylidene and/or beta-double bond isomer and about 1 to 10 mole % of tetrasubstituted double bond isomer. In an embodiment of the invention the high vinylidene PIB has an alpha- and/or beta-vinylidene double bond isomer content of 55 mole % or greater, and in other embodiments has an alpha-vinylidene and/or beta-double bond isomer content of 65, of 75, or of 85 mole % or greater. High vinylidene PIBs are prepared by polymerizing isobutylene or an isobutylene containing composition with a milder acidic polymerization catalyst such as $BF_3$. High vinylidene PIBs are available commercially from several producers including BASF and Texas Petroleum Chemicals.

The number average molecular weight (Mn) range of a polyolefin, whether conventional or high vinylidene, can be from about 300-10,000 or even up to 50,000. However, for instance, the preferred range for PIB can be Mn of about 300-5,000 and the most preferred upper limit Mn can be in the range of about Mn 300-2,500, or 300-1,500. In general, the polyolefin may be prepared from polymerisable monomers containing about 2 to about 16, or about 2 to about 8, or about 2 to about 6 carbon atoms. Often the polymerisable monomers comprise one or more of propylene, isobutene, 1-butene, isoprene, 1,3-butadiene, or mixtures thereof.

The polyolefin may also be a copolymer of at least two different olefins, also known as an olefin copolymer (OCP). These copolymers are preferably copolymers of α-olefins having from 2 to about 28 carbon atoms, preferably copolymers of ethylene and at least one α-olefin having from 3 to about 28 carbon atoms, typically of the formula $CH_2$=$CHR_1$ wherein $R_1$ is a straight chain or branched chain alkyl radical comprising 1 to 26 carbon atoms. Examples of α-olefins include monoolefins such as propylene, 1-butene, isobutene, 1-pentene, 1-hexene, 1-heptene, 1-octene, 1-nonene, 1-decene, etc. Preferably $R_1$ in the above formula can be an alkyl of from 1 to 8 carbon atoms, and more preferably can be an alkyl of from 1 to 2 carbon atoms. Preferably, the polymer of olefins is an ethylene-propylene copolymer.

Where the olefin copolymer includes ethylene, the ethylene content is preferably in the range of 20 to 80 percent by weight, and more preferably 30 to 70 percent by weight. When propylene and/or 1-butene are employed as comonomer(s) with ethylene, the ethylene content of such copolymers is most preferably 45 to 65 percent, although higher or lower ethylene contents may be present.

The Mn range of OCP can typically be up to 150,000 or higher, e.g., 1,000 or 5,000 to 150,000 or to 120,000 or to 100,000, e.g., 10,000 to 50,000 and especially 10,000 to 15,000 (e.g., about 12,000) or 30,000 to 50,000 (e.g., about 40,000). In one embodiment, the OCP can have an Mn of greater than 5,000, for instance, greater than 5000 to 150,000. Other combinations of the above-identified molecular weight limitations are also contemplated.

Polyolefin acylating agents can be prepared by reacting the polyolefin and acylating agent in a thermal process or a chlorine process. A discussion of thermal process and chlorine process can be found, for example, in paragraphs [0013] to

[0017] of WO 2005/012468, published Feb. 10, 2005 to Eveland et al. As discussed in the WO'468 publication, further reference can be had to U.S. Pat. Nos. 6,165,235; 4,152,499 and 5,275,747 for information relating to polyolefin acylating agents.

Amounts of reactants in either process can range from about 0.5, often from about 0.6 moles acylating agent per mole of polyolefin up to 3 moles acylating agent per mole of polyolefin. In one embodiment, from about 0.8 moles of acylating can be used per mole of polyolefin to about 1.2 moles acylating agent per mole of polyolefin, even more often from about 0.95 moles acylating agent per mole of polyolefin, to about 1.05 moles acylating agent per mole of polyolefin. In another embodiment, more than 1.5 moles of acylating agent, preferably from about 1.6 to 3 moles, are used per mole of polyolefin. In this embodiment, preferably from about 1.8 to about 2.5 moles acylating agent are used per mole of polyolefin, more preferably from about 1.9 to about 2.1 moles acylating agent per mole of polyolefin.

In such an embodiment where the polyolefin is a high vinylidene polyolefin, the polyolefin can have an average of between about 1.0 and 2.0 acylating agent moieties per polymer. For example, the polyolefin acylating agent may be a high vinylidene poly(isobutylene) succinic anhydride (PIBSA) wherein the PIB from which the PIBSA is derived contains at least 50 mol % methylvinylidene terminated molecules.

To create the dispersant composition of the first aspect of the invention the polyolefin acylating agent can be reacted with a hydroxyl terminated or amine terminated polyether. In one embodiment, the polyolefin acylating agent can be reacted with a hydroxyl terminated or amine terminated polyether in a ratio of from about 4:1 to 1:4, or from about 2:1 to 1:2, or even 1.1:1 to 1:1.1 on a basis of moles of polyolefin acylating agent to hydroxyl terminated or amine terminated polyether.

In one embodiment, the polyether can have an Mn of between about 100 and 1500, and in another embodiment, the polyether can have an Mn of between about 200 and 1200, or 300 and 1000. In certain embodiments, the polyether can have an Mn of between about 600 and 900.

Polyether according to one aspect of the invention can be prepared by generally known routes, or purchased as commercially available compounds.

In one embodiment of the invention, hydroxyl terminated and amine terminated polyethers can comprise units derived from formula I:

Formula I

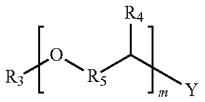

wherein:

$R_3$ can be hydrogen (H), —$R_6$OH, —$R_6NH_2$, —(C═O)$R_6$, —$R_6$—N(H)C(═O)$R_6$, or a hydrocarbyl group of from 1 to 30 carbon atoms, or 1 to 20, or 1 to 10 carbon atoms, and in some embodiments 1 to 6, or 1 to 4, or 1 or 2 carbon atoms, and preferably $R_3$ can be H or a methyl group, $R_4$ can be H, or a hydrocarbyl group of from 1 to 10 carbon atoms, or 1 to 8, or 1 to 6 carbon atoms, and preferably $R_4$ can be H or a methyl group, i.e. a single carbon hydrocarbyl group, $R_5$ can be a straight or branched hydrocarbylene group of from 1 to 6 carbon atoms, or 1 to 4, or 1 or 2 carbon atoms, and preferably $R_5$ can be a methylene group, $R_6$ can be a hydrocarbylene group of 1 to 20 carbon atoms, or 1 to 10 carbon atoms and in some embodiments 1 to 6, or 1 to 4, or 1 or 2 carbon atoms, and preferably $R_6$ can be $CH_2CH(CH_3)$, Y can be $NR_7R_8$ or OH, and in certain embodiments Y can be $R_6NH_2$ or $R_6$OH, and preferably Y can be $NH_2$ or OH, $R_7$, and $R_8$, independently, can be H, or a hydrocarbyl group of from 1 to 50 carbon atoms in which up to one third of the carbon atoms can be substituted by N or functionalized with additional polyether of Formula I, and m can be an integer from 1 to 30, or from 2 to 20, or 3 to10, and more preferably 3 to 7.

As used herein, the term "hydrocarbyl substituent" or "hydrocarbyl group" or "hydrocarbylene group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy);

hetero substituents, that is, substituents which, while having a predominantly hydrocarbon character, in the context of this invention, contain other than carbon in a ring or chain otherwise composed of carbon atoms and encompass substituents as pyridyl, furyl, thienyl and imidazolyl. Heteroatoms include sulfur, oxygen, and nitrogen. In general, no more than two, or no more than one, non-hydrocarbon substituent will be present for every ten carbon atoms in the hydrocarbyl group; alternatively, there may be no non-hydrocarbon substituents in the hydrocarbyl group.

In certain embodiments, the polyether of formula I can be an amine terminated polyether of between about 600 and 1200 Mn, that is, where Y is $NH_2$. In such embodiments, $R_3$ can preferably be, for example, methyl or $CH_2CH(CH_3)NH_2$. Similarly, $R_4$ can preferably be H or methyl, and preferably $R_5$ can be methylene. Preferred values for m can be between 3 and 22, or 10 to 20. In certain embodiments of the amine terminated polyether, m can be about 3 or 4, or about 10 to 13, preferably 10 or 12 to 13, and in other embodiments from about 18 to 22, preferably 18 to 19 or 22.

In certain other embodiments, the polyether can be a hydroxyl terminated polyether of between about 100 and 600 Mn, that is, where Y is OH. In such embodiments, $R_3$ can be, for example, H or methyl, more preferably H. Similarly, $R_4$ is preferably H and $R_5$ is preferably methylene. Preferred values for m can be between 2 and 13, or 5 to 10. In certain embodiments of the hydroxyl terminated polyether, m can be 2 or 3, or about 6 to 7 or 7, or about 13.

In one embodiment, when $R_4$ is an alkyl, $R_5$ is a linear alkyl, preferably methylene. Likewise, in some embodiments when $R_5$ is a branched alkyl, $R_4$ is H.

It is to be understood that the polyethers encompassed by the above formulas can have different end groups from the repeat unit of Formula I. The end groups, for example, may be slightly altered depending on the method of initiation of the polyether. However, the end groups will themselves be encompassed by Formula I. Thus, the polyethers contemplated herein can include repeat units of Formula I and combinations of variations of Formula I. For example, as in the formula directly following:

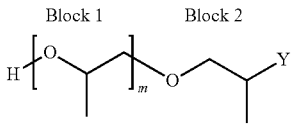

where Y is OH. Notably, both block 1 and block 2 are encompassed by Formula I. In block 1, $R_5$ is a branched alkyl, and $R_4$ is H, whereas in block 2, $R_5$ is methylene and $R_4$ is methyl, so that the formula is a combination of variations of Formula I.

In another example, Formula I can encompass the block polyether directly following:

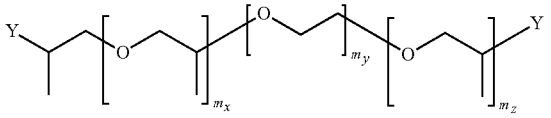

where, as compared to Formula I, $R_5$ is methylene, $R_4$ is either methyl or H, Y is preferably $NH_2$ and $m_x$, $m_y$ and $m_z$ designate the respective blocks.

An example hydrocarbyl group of from 1 to 20 carbon atoms, i.e. $R_6$, can include an aryl, aliphatic, cycloaliphatic, linear or branched hydrocarbyl. In one embodiment, $R_6$ can be represented by:

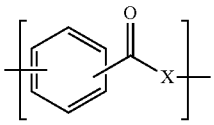

where x can be from 1 to 10 carbon atoms.

An example hydrocarbyl group of Formula I having from 1 to 50 carbon atoms in which up to one third of the carbon atoms can be substituted by N can encompass, for example, an amine having at least 4 aromatic groups, at least one $NH_2$ functional group, and at least 2 secondary or tertiary amino groups, for example, represented by the formula;

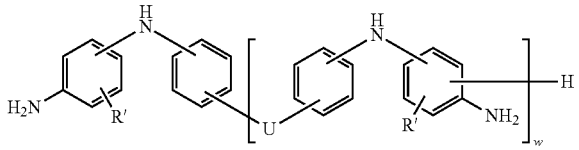

wherein independently each variable,

R' can be H or $R_5$,

U can be an aliphatic, alicyclic or aromatic group, with the proviso that when U is aliphatic, the aliphatic group may be a linear or branched alkylene group containing 1 to 5, or 1 to 2 carbon atoms; and w may be 1 to 10, or 1 to 4, or 1 to 2 (typically 1).

Further examples of hydrocarbyl groups as shown in the preceding formula can be found as described in paragraphs [0030] to of U.S. Publication #2011/0306528, to Gieselman et al., published Dec. 15, 2011.

An example hydrocarbyl group of Formula I having from 1 to 50 carbon atoms in which up to one third of the carbon atoms can be substituted by N can also encompass, for example, an aminopropyl amine or ethoxylated aminopropylamine, such as the Duomeen™ line of amines from AkzoNobel, of the following general formula.

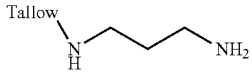

According to the polyether of Formula I, a hydrocarbyl group having from 1 to 50 carbon atoms in which up to one third of the carbon atoms can be substituted by N, can also be functionalized with additional polyether of Formula I. This functionalization can be arrived at, for example, by reacting the based hydrocarbyl group with a oxide, for example, ethylene oxide, under elevated temperature and pressure. An example of such functionalization can be seen in a compound of the following formula;

Formula II

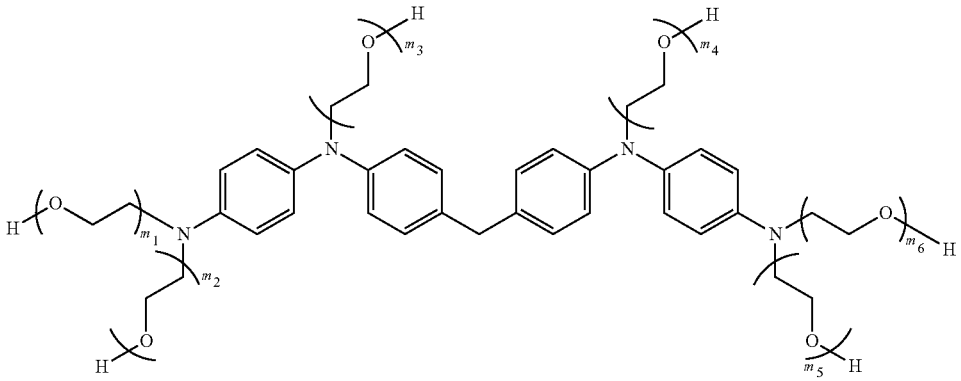

where each m individually can be 0, 1, 2, 3 or 4 and where $m_1+m_2+m_3+m_4+m_5+m_6$ can be between 4 and 24, or between 6 and 22, or between 8 and 20, and in certain embodiments the total of $m_1+m_2+m_3+m_4+m_5+m_6$ can be 10 or 20.

Another example of a polyether having functionalization with additional polyether of Formula I can be seen in a compound of the following formula;

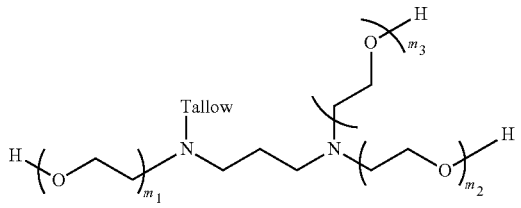

wherein each m individually can be 0, 1, 2, 3, 4 or 5 and where $m_1+m_2+m_3$ can be between 2 and 15, or between 3 and 12, or between 4 and 10, and in certain embodiments the total of $m_1+m_2+m_3$ can be 3, or 10, or 15.

A still further example can be seen in the following formula;

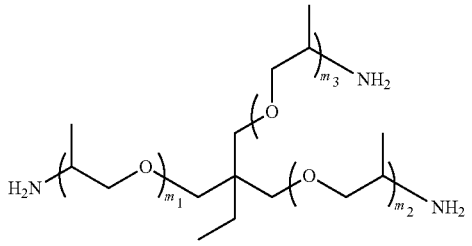

wherein each m individually can be 0, 1, 2, 3, 4 or 5, and where $m_1+m_2+m_3$ can be between 2 and 10, or between 3 and 9, or between 4 and 8, and in certain embodiments where the total of $m_1+m_2+m_3$ can be 5 or 6.

The polyolefin acylating agent and the amine or hydroxyl terminated polyether can be reacted at elevated temperature to form the dispersant composition. Typically, the reaction of the polyolefin acylating agent and hydroxyl terminated polyether can require an acid catalyst to achieve greater conversion. In some embodiments, prior to reaction with the polyolefin acylating agent to create the dispersant composition, the hydroxyl terminated or amine terminated polyether can be reacted with an acid or anhydride, such as anthranilic acid or isatoic anhydride.

The dispersant composition can additionally be reacted with an amine, preferably the amine can be a polyamine, and preferably an aliphatic polyamine. The amine may be an aliphatic polyamine such as ethylene polyamine (i.e., a polyethylene polyamine)), a propylene polyamine, a butylene polyamine, or a mixture of two or more thereof. The aliphatic polyamine may be ethylene polyamine. The aliphatic polyamine may be selected from ethylenediamine, diethylenetriamine, triethylenetetramine, tetraethylenepentamine, pentaethylenehexamine, polyamine still bottoms, or a mixture of two or more thereof. The acid number of the dispersant composition can be measured and a sufficient amount of polyamine may be reacted with the dispersant composition to neutralize any residual acid in the dispersant composition.

In another aspect of the invention, the dispersant composition described can be incorporated in a lubricant composition with an oil of lubricating viscosity and optional other performance additives.

In one embodiment, the dispersant composition described herein may be added to an oil of lubricating viscosity in a range of 0.01 wt % to 20 wt %, or 0.05 wt % to 10 wt %, or 0.08 wt % to 5 wt %, or 0.1 wt % to 3 wt %, or even 0.3 wt % to 2 wt % of the lubricating composition.

Oils of lubricating viscosity can include, for example, natural and synthetic oils, oil derived from hydrocracking, hydrogenation, and hydrofinishing, unrefined, refined and re-refined oils and mixtures thereof. Oils of lubricating viscosity may also be defined as specified in the American Petroleum Institute (API) Base Oil Interchangeability Guidelines.

A more thorough elaboration of the various oils that can be employed in the present invention can be found in paragraphs [0104] to [0111] of U.S. Publication #2011/0306528, to Gieselman et al., published Dec. 15, 2011.

The lubricant composition may be in the form of a concentrate and/or a fully formulated lubricant. If the polymer of the present invention is in the form of a concentrate (which may be combined with additional oil to form, in whole or in part, a finished lubricant), the ratio of the polymer to the oil of lubricating viscosity and/or to diluent oil include the ranges of 1:99 to 99:1 by weight, or 80:20 to 10:90 by weight.

The composition can optionally comprise other performance additives as well. The other performance additives can comprise at least one of metal deactivators, dispersants, viscosity modifiers, friction modifiers, antiwear agents, corrosion inhibitors, dispersant viscosity modifiers, extreme pressure agents, antiscuffing agents, antioxidants, foam inhibitors, demulsifiers, pour point depressants, seal swelling agents and mixtures thereof. Typically, fully-formulated lubricating oil will contain one or more of these performance additives.

The lubricant composition optionally further comprises known neutral or overbased detergents. Suitable detergent substrates include phenates, sulfur containing phenates, sulfonates, salixarates, salicylates, carboxylic acid, phosphorus acid, mono- and/or di-thiophosphoric acid, alkyl phenol, sulfur coupled alkyl phenol compounds, or saligenins.

Various overbased detergents and their methods of preparation are described in greater detail in numerous patent publications, including WO2004/096957 and references cited therein. In one embodiment, the lubricant composition can comprise a calcium sulfonate overbased detergent, or a sodium or magnesium sulfonate overbased detergent. In another embodiment, the lubricant composition can comprise a calcium phenate detergent. In still another embodiment, the lubricant composition can comprise a combination of a calcium sulfonate and at least one of a calcium phenate, sodium sulfonate, or magnesium sulfonate overbased detergent.

The detergent may be present at 0 wt % to 10 wt %, or 0.1 wt % to 8 wt %, or 1 wt % to 4 wt %, or greater than 4 to 8 wt %. In particular, further dispersants may be employed in a lubricant composition with the dispersant composition.

Overbased detergents are often characterized by Total Base Number (TBN). TBN is the amount of strong acid needed to neutralize all of the overbased material's basicity, expressed as potassium hydroxide (mg KOH per gram of sample). Since overbased detergents are commonly provided in a form which contains a certain amount of diluent oil, for example, 40-50% oil, the actual TBN value for such a detergent will depend on the amount of such diluent oil present, irrespective of the "inherent" basicity of the overbased material. For the purposes of the present invention, the TBN of an overbased detergent is to be recalculated to an oil-free basis. Detergents which are useful in the present technology may typically have a TBN (oil-free basis) of 100 to 800, and in one embodiment 150 to 750, and in another, 400 to 700. If multiple detergents are employed, the overall TBN of the detergent component (that is, an average of all the specific detergents together) will typically be in the above ranges, and the required contribution to the TBN of the metal-containing detergent component will be the total of the contributions of each individual detergent.

The overall TBN of the composition, including oil, will be derived from the TBN contribution of the individual components, such as the dispersant, the detergent, and other basic materials. The overall TBN will, in some embodiments, be at least 4 or at least 6, or sometimes even at least 8. The amount of TBN provided by the metal-containing detergent will be at least 1, or at least 2, or at least 4, or at least 6, and the amount of the metal containing detergent or detergents will typically be an amount suitable to provide such TBN levels. In certain embodiments, the actual amount of the metal-containing detergent (or detergents) may be 0.2 to 5 percent by weight or 0.3 to 3 percent or 0.5 to 2 percent or 0.9 to 1.5 percent by weight. The skilled person will recognize that, if a metal-containing detergent is used at 0.2 percent by weight and it is to contribute at least 2 TBN to the formulation, then that detergent itself must have a TBN of at least 1000 (amounts and TBN values expressed on oil-free basis).

In one embodiment the dispersant composition can contain additional dispersants. Dispersants are often known as ashless-type dispersants because, prior to mixing in a lubricating oil composition, they do not contain ash-forming metals and they do not normally contribute any ash forming metals when added to a lubricant and polymeric dispersants. Ashless type dispersants are characterized by a polar group attached to a relatively high molecular weight hydrocarbon chain. Typical ashless dispersants include N-substituted long chain alkenyl succinimides. Examples of N-substituted long chain alkenyl succinimides include PIB succinimide with number average molecular weight of the PIB substituent in the range 350 to 5000, or 500 to 3000. Succinimide dispersants and their preparation are disclosed, for instance in U.S. Pat. No. 4,234,435. Succinimide dispersants are typically the imide formed from a polyamine, typically a polyethylene polyamine or an aromatic polyamine, such as amino diphenylamine (ADPA).

In one embodiment, the lubricant composition can further comprise the reaction product of a PIB succinic anhydride and an amine, preferably a polyamine, and preferably an aliphatic polyamine, such as ethylene polyamine (i.e., a polyethylene polyamine), a propylene polyamine, a butylene polyamine, or a mixture of two or more thereof. The aliphatic polyamine may be ethylene polyamine. The aliphatic polyamine may be selected from ethylenediamine, diethylenetriamine, triethylenetetramine, tetraethylenepentamine, pentaethylenehexamine, polyamine still bottoms, or a mixture of two or more thereof.

In one embodiment the lubricant composition further comprises at least one PIB succinimide dispersant derived from PIB with number average molecular weight in the range 350 to 5000, or 500 to 3000. The PIB succinimide may be used alone or in combination with other dispersants.

Another class of ashless dispersant is Mannich bases. Mannich dispersants are the reaction products of alkyl phenols with aldehydes (especially formaldehyde) and amines (especially polyalkylene polyamines). The alkyl group typically contains at least 30 carbon atoms.

The dispersants may also be post-treated by conventional methods by a reaction with any of a variety of agents. Among these are boron, urea, thiourea, dimercaptothiadiazoles, carbon disulfide, aldehydes, ketones, carboxylic acids, hydrocarbon-substituted succinic anhydrides, maleic anhydride, nitriles, epoxides, phosphorus compounds and/or metal compounds.

The dispersant may be present at 0 wt % to 20 wt %, or 0.1 wt % to 15 wt %, or 0.1 wt % to 10 wt %, or 1 wt % to 6 wt %, or 7 wt % to 12 wt % of the lubricating composition.

The total combined amount of the optional performance additives present in one embodiment from 0 or 0.01 wt. % to 50 wt. %, in another embodiment 0 or 0.01 to 40 wt. %, in another embodiment 0 or 0.01 to 30 wt. % and in another embodiment 0.05 or 0.1 or 0.5 to 20 wt. % of the lubricating composition. In one embodiment, the total combined amount of the additional performance additive compounds present on an oil free basis ranges from 0 wt % to 25 wt % or 0.01 wt % to 20 wt % of the composition. Although, one or more of the other performance additives may be present, it is common for the other performance additives to be present in different amounts relative to each other.

INDUSTRIAL APPLICATION

The lubricating composition may be utilized in an internal combustion engine. The internal combustion engine may or may not have an Exhaust Gas Recirculation system.

In one embodiment the internal combustion engine may be a diesel fuelled engine (typically a heavy duty diesel engine), a gasoline fuelled engine, a natural gas fuelled engine or a mixed gasoline/alcohol fuelled engine. In one embodiment the internal combustion engine may be a diesel fuelled engine and in another embodiment a gasoline fuelled engine. In one embodiment the engine may be a spark ignited engine and in one embodiment a compression engine.

The internal combustion engine may be a 2-stroke or 4-stroke engine. Suitable internal combustion engines include marine diesel engines, aviation piston engines, low-load diesel engines, and automobile and truck engines.

The lubricant composition for an internal combustion engine may be suitable for any engine lubricant irrespective of the sulfur, phosphorus or sulfated ash (ASTM D-874) content. The sulfur content of the engine oil lubricant may be 1 wt % or less, or 0.8 wt % or less, or 0.5 wt % or less, or 0.3 wt % or less. In one embodiment the sulfur content may be in the range of 0.001 wt % to 0.5 wt %, or 0.01 wt % to 0.3 wt %. The phosphorus content may be 0.2 wt % or less, or 0.1 wt % or less, or 0.085 wt % or less, or even 0.06 wt % or less, 0.055 wt % or less, or 0.05 wt % or less. In one embodiment the phosphorus content may be 100 ppm to 1000 ppm, or 325 ppm to 700 ppm. The total sulfated ash content may be 2 wt % or less, or 1.5 wt % or less, or 1.1 wt % or less, or 1 wt % or less, or 0.8 wt % or less, or 0.5 wt % or less. In one embodiment the sulfated ash content may be 0.05 wt % to 0.9 wt %, or 0.1 wt % to 0.2 wt % to 0.45 wt %.

In one embodiment the lubricating composition is an engine oil, wherein the lubricating composition is characterized as having at least one of (i) a sulfur content of 0.5 wt % or less, (ii) a phosphorus content of 0.1 wt % or less, and (iii) a sulfated ash content of 1.5 wt % or less.

The dispersant composition and the lubricating compositions containing the dispersant composition can be employed in a method of improving one of deposit performance and seal performance in an engine by applying the dispersant composition or lubricating composition containing the dispersant composition to the engine.

The dispersant composition and the lubricating compositions containing the dispersant composition also can be employed in a method of improving nitration and oxidation performance and maintaining TBN of an engine oil, by applying to the engine oil the dispersant composition or the lubricating compositions containing the dispersant composition. An additional amount of a PIB Succinimide, such as the reaction product of a PIB succinic anhydride and an amine, preferably an aliphatic amine, and preferably an aliphatic polyamine, such as, for example, polyethyleneamine (PEPA), may be employed in the method.

The amount of each chemical component described is presented exclusive of any solvent or diluent oil, which may be customarily present in the commercial material, that is, on an active chemical basis, unless otherwise indicated. However, unless otherwise indicated, each chemical or composition referred to herein should be interpreted as being a commercial grade material which may contain the isomers, by-products, derivatives, and other such materials which are normally understood to be present in the commercial grade.

It is known that some of the materials described above may interact in the final formulation, so that the components of the final formulation may be different from those that are initially added. For instance, metal ions (of, e.g., a detergent) can migrate to other acidic or anionic sites of other molecules. The products formed thereby, including the products formed upon employing the composition of the present invention in its intended use, may not be susceptible of easy description. Nevertheless, all such modifications and reaction products are included within the scope of the present invention; the present invention encompasses the composition prepared by admixing the components described above.

All percent values, concentrations, and/or ratios included herein, unless otherwise indicated, are provided on a weight basis.

EXAMPLES

Samples 1-9—Amine Terminated Polyether ($Y{=}NH_2$)

A flask is charged with a polyolefin acylating agent. For sample 1-4 the polyolefin in the polyolefin acylating agent is an ethylene propylene copolymer and for samples 5-9 the polyolefin is poly(isobutylene). Oil is additionally added as needed, and the reaction mixture is heated. A commercial amine terminated polyether is added subsurface and the temperature of the mixture is increased. For sample 7 & 8, the commercial amine terminated polyether is first reacted with isatoic anhydride. The reaction product is a light brown clear thick liquid.

| | 1 | 2 | 3 | 4 | 5 |
|---|---|---|---|---|---|
| Commercial Amine Terminated Poly-ether reported Mn | 600 | 900 | 1000 | 600 | 600 |
| "$R_3$" | methyl | $CH_2CH(CH_3)NH_2$ | methyl | $CH_2CH(CH_3)NH_2$ | $CH_2CH(CH_3)NH_2$ |
| "$R_4$" | H/methyl | H/methyl | H/methyl | H/methyl | H/methyl |
| "$R_5$" | methylene | methylene | methylene | methylene | methylene |
| "m" | 10 | 18-19 | 22 | 12-13 | 12-13 |
| Molar Ratio CO:N | 2CO:1N | 2CO:1N | 2CO:1N | 2CO:1N | 1CO:0.6N |
| % Oil | 46 | 80 | 50 | 80 | 0 |
| TBN | 0.55 | 0.11 | 0.67 | 3.23 | 8.05 |
| TAN | 2.87 | 2.25 | 3.02 | 0.69 | 4.15 |
| % Yield | 98 | 99 | 98 | 98 | 97 |

| | 6 | 7 | 8 | 9 |
|---|---|---|---|---|
| Commercial Amine Terminated Poly-ether reported Mn | 220 | 220 (precursor) | 220 (precursor) | 600 |
| "$R_3$" | $CH_2CH(CH_3)NH_2$ | NH—C(O)—aryl-$NH_2$ | —NH—C(O)—aryl-$NH_2$ | $CH_2CH(CH_3)NH_2$ |
| "$R_4$" | H/methyl | H/methyl | H/methyl | H/methyl |
| "$R_5$" | methylene | —NH—C(O)—aryl- | —NH—C(O)—aryl- | methylene |
| "m" | 3-4 | 3-4 | 3-4 | 12-13 |
| Molar Ratio CO:N | 1CO:0.4N | 1CO:0.5N | 1CO:0.5N | 2CO:1N |
| % Oil | 0 | 40 | 50 | 0 |

-continued

| | | | | |
|---|---|---|---|---|
| TBN | 9.37 | 3.06 | 3.13 | 2.17 |
| TAN | 3.4 | 4.47 | 3.38 | 6.66 |
| % Yield | 97 | 94 | 93 | 98 |

Samples 10-12—PEG Esters (Y═OH)

A flask is charged with a PIBSA and heated. A polyethylene glycol of 300 Mn is added in two portions; one portion without acid catalyst, one portion with acid catalyst. The final reaction product is a dark brown thick liquid.

| | 10 | 11 | 12 |
|---|---|---|---|
| PEG "$R_3$" | H | H | H |
| PEG "$R_4$" | H | H | H |
| PEG "$R_5$" | Methylene | methylene | methylene |
| PEG "m" | 6-7 | 6-7 | 6-7 |
| Molar Ratio CO:OH: Catalyst | 1CO:1.25OH: 0.04H+ | 1CO:1OH: 0.04H+ | 1CO:1.25OH: 0.04H+ |
| TAN | 3.03 | | |
| % Yield | 97 | 98 | 98 |

Samples 13-17—Other PAG Esters (Y═OH)

A flask is charged with a PIBSA and a PAG and heated. For sample 17, the flask is charged with a functionalized ethylene propylene copolymer. Acid catalyst is added. The final reaction product is a dark brown thick liquid.

| | 13 | 14 | 15 | 16 | 17 |
|---|---|---|---|---|---|
| PAG Mn | 106 | 106 | 150 | Formula III, $m_1 + m_2 + m_3 = 15$ | 350 |
| PAG "$R_3$" | H | H | H | | methyl |
| PAG "$R_4$" | H | H | H | | H |
| PAG "$R_5$" | methylene | methylene | methylene | | methylene |
| PAG "m" | 2 | 2 | 3 | | 7 |
| Molar Ratio CO:OH: Catalyst | 1CO: 1.25OH: 0.04H+ | 1CO: 1.25OH: 0.04H+ | 1CO: 1.25OH: 0.04H+ | 1CO: 1OH: 0.01H+ | 1CO: 1.25OH: 0.04H+ |
| TAN | 5.55 | 4.75 | 5.65 | 23 | 4.9 |
| % Yield | 97 | 96 | 97 | 97 | 98 |

Sample 18—PAG Ester (Y═OH) Capped with Amine

A flask is charged with Sample 13 and heated. The acid number of Sample 13 is measured and a sufficient amount of polyamine is added to neutralize any residual acid in the Sample. The final reaction product is a very thick clear brown liquid.

| | 18 |
|---|---|
| Molar Ratio | (1CO:1N) |
| TAN | 3.55 |
| TBN | 0.0 |
| % Yield | 97 |

Sample 19—PAG Ester (Y═OH) Capped with Boric Acid

A flask is charged with Sample 10 and boric acid and heated. Oil is added. The final reaction product is a very thick clear brown liquid.

| | 19 |
|---|---|
| Molar Ratio | (1OH:2BOA) |
| TAN | 6.95 |
| TBN | — |
| % Yield | 96 (14% oil) |

Example 1

Passenger Car Formulation Testing with PIB Succinimide

The Samples are tested in the passenger car engine oil formulation shown below, for deposit and seal performance.

| Ingredient | Active wt % |
|---|---|
| Oil | balance |
| Viscosity Modifier | 1.23 |
| Pour Point Depressant | 0.192 |
| Anti-Oxidant | 2 |
| Calcium Sulfonate Detergent | 0.059 |
| Calcium Phenate Detergent | 1.448 |
| Antiwear | 0.4575 |
| Antifoam | 0.00125 |
| Friction Modifier | 0.05 |
| Dispersant | 0.2 |
| Oxidation Inhibitor | 0.048 |
| Corrosion Inhibitor | 0.05 |
| PIB Succinimide | 4.9 |

Deposit performance can be measured according to the Thermo-Oxidation Engine Oil Simulation Test (TEOST 33) as presented in ASTM D6335. The results of the TEOST 33 test show the milligrams of deposit after an engine oil is run at elevated temperatures. Lower TEOST 33 results are preferred. Likewise, performance can be measured according to the Komatsu Hot Tube Deposits screen test (KHT), which provides a merit rating on a scale of 0 to 10, 0 being heavy deposits and 10 being no deposit.

Seal performance can be measured by the Mercedes-Benz supply specification (MB DBL 6674). The MB test involves immersing a fluorocarbon elastomer in a beaker containing 350 mL of the sample to be evaluated and heating it to 150° C.

for 168 hours. The change in tensile strength (T/S) and rupture elongation (R/E) of the sample after treatment is measured. Results closer to zero indicate better seal compatibility.

The first table below shows results from replacing all or part of the 4.9 active wt. % of the PIB Succinimide in the formulation. The second table shows results when top-treating the examples in the formulation to achieve 7.9 wt. % total dispersant actives.

| | Sample wt % actives | PIB Succinimide wt % actives | TEOST 33 (mg deposit) | KHT (rating) | Seals T/S_Change % | Seals R/E_Change % |
|---|---|---|---|---|---|---|
| control 1 | — | 4.9 | 16.3 | 2 | −30.4 | −35.6 |
| control 2 | — | 2.8 | 25.1 | 2 | −54.4 | −51 |
| Sample 5 | 2.1 | 2.8 | 18.1 | 7 | −45.9 | −43.3 |
| Sample 6 | 2.1 | 2.8 | 16.9 | 7 | −39.8 | −39.6 |
| Sample 7 | 2.1 | 2.8 | 11.8 | 1 | −24 | −14.6 |
| Sample 8 | 2.1 | 2.8 | 18.6 | 1 | −18.1 | −7 |
| Sample 10 | 2.1 | 2.8 | 10.1 | 9 | −22 | −29 |
| Sample 13 | 2.1 | 2.8 | 11.6 | 2/3* | −15.8 | −22.5 |
| Sample 16 | 2.1 | 2.8 | 10.3 | 5 | −62.9 | −57.9 |
| Sample 18 | 2.1 | 2.8 | 13.1 | 3 | −10.8 | 6.8 |
| Sample 19 | 2.1 | 2.8 | 16.9 | 9 | −17.6 | −24.9 |

*repeated run

| | Sample wt % actives | PIB Succinimide wt % actives | TEOST 33 (mg deposit) |
|---|---|---|---|
| control 3 | — | 7.9 | 15.7 |
| Sample 1 | 3 | 4.9 | 10.8 |
| Sample 2 | 3 | 4.9 | 7.8 |
| Sample 3 | 3 | 4.9 | 14.8 |
| Sample 4 | 3 | 4.9 | 7 |
| Sample 11 | 3 | 4.9 | 10.8 |
| Sample 12 | 3 | 4.9 | 12.3 |
| Sample 13 | 3 | 4.9 | 11.8 |
| Sample 15 | 3 | 4.9 | 8.2 |
| Sample 17 | 3 | 4.9 | 8.2 |

Example 2

Passenger Car Formulation Testing with PIB Succinimide

The Samples are tested in another passenger car engine oil formulation, shown below, for deposit performance.

| Ingredient | Active wt % |
|---|---|
| Oil | Balance |
| Viscosity Modifier | 0.621 |
| Pour Point Depressant | 0.115 |
| Anti-Oxidant | 1.45 |
| Calcium Sulfonate Detergent | 0.7424 |
| Sodium Sulfonate Detergent | 0.1725 |
| Antiwear | 0.7892 |
| Antifoam | 0.00125 |
| Friction Modifier | 0.1 |
| Oxidation Inhibitor | 0.048 |
| Corrosion Inhibitor | 0.05 |
| PIB Succinimide | 2.1 |

The PIB Succinimide dispersant is top treated with an additional 2.0 active wt % PIB Succinimide and compared to the formulation on its own as well as a formulation top treated with 2.0 active wt. % of example 12. The results are shown in the table below.

| | Sample wt % actives | PIB Succinimide wt % actives | TEOST 33 (mg deposit) |
|---|---|---|---|
| control 4 | — | 4.1 | 29.1 |
| control 5 | — | 2.1 | 22.4 |
| Sample 14 | 2 | 2.1 | 17.5 |

Example 3

Diesel Formulation 1 Testing

The Samples are tested in the diesel engine oil formulation below for deposit and seals performance, as well as nitration and oxidation performance and TBN retention.

| Ingredient | Active wt % |
|---|---|
| oil | Balance |
| Pour Point Depressant | 0.08 |
| Viscosity Modifier | 0.65 |
| Dispersant VM | 0.5025 |
| Corrosion Inhibitor | 0.02 |
| Anti-Oxidant | 1.7 |
| Calcium Sulfonate Detergent | 0.78 |
| Magnesium Sulfonate Detergent | 0.714 |
| Saligenin Detergent | 0.5 |
| Dispersant | 2.38 |
| Antiwear | 1 |
| Antifoam | 0.01 |
| PIB Succinimide | 2 |

For deposit performance, the formulation was additionally evaluated by the panel coker test. Panel coker involves splashing test oil at 105° C. for 4 hours onto an aluminum panel maintained at 325° C. Digital imaging of resulting deposits provides a Universal Rating on a scale of 0-100, with higher ratings indicating better performance.

The oxidation and nitration tests assess the oxidation and nitration resistance of lubricants. Oxidation of the components of the lubricating oil will lead to an increase in the amount of C═O functionality present, while nitration of the components of the lubricating oil will lead to an increase in various nitrogen-containing products represented by the structures $RONO_2$. Nitric Acid and Fe-Napthanoate are mixed into the lubricant, 50 cc/min of NOx purges the sample for 22 hours in a 145° C. bath. The end of test sample is evaluated by FTIR for percent C═O increase (peak area at 1665-1820 $cm^{-1}$) and $RONO_2$ (peak height at 1629+/−20 $cm^{-1}$). TBN retention can also be measured during the nitration and oxidation test by comparing the TBN at the start of test (SOT) and end of test (EOT).

Sample 12 is evaluated in the formulation at a full active replacement for the PIB Succinimide dispersant, at partial replacement, and top treated. The results are shown in the table below.

| | Sample wt % actives | PIB Succinimide wt % actives | TEOST 33 (mg deposit) | Panel Coker (325) (merit) | Nitration (RONO2/C═O) | Nitration TBN (SOT/EOT) | Seals T/S_Change % | Seals R/E_Change % |
|---|---|---|---|---|---|---|---|---|
| control 6 | — | 2 | 17.2 | 10 | 16/21.7 | 9.6/0.2 | −33.1 | −34.7 |
| Sample 14 | 2 | 0 | 23.2 | 12 | 15.8/18.3 | 8.8/3.6 | 1.9 | −12.1 |
| Sample 14 | 1 | 1 | 16.6 | 17 | 12.6/17.6 | 8.8/1.2 | −13.5 | −28.8 |
| Sample 14 | 2 | 2 | 13.3 | 27 | 13.9/23.2 | 9.6/1.1 | −23.4 | −37 |

Example 4

Diesel Formulation 2 Testing

The Samples are tested in another diesel engine oil formulation, shown below.

| Ingredient | Active wt % |
|---|---|
| oil | Balance |
| Pour Point Depressant | 0.08 |
| Viscosity Modifier | 0.65 |
| Dispersant VM | 0.67 |
| Corrosion Inhibitor | 0.02 |
| Anti-Oxidant | 1.24 |
| Calcium Sulfonate Detergent | 0.8993 |
| Calcium Phenate Detergent | 0.8102 |
| Dispersant | 0.092 |
| Antiwear | 1 |
| Antifoam | 0.01 |
| PIB Succinimide | 4.1 |

Samples 7 and 8 are evaluated in the formulation at a partial active replacement for the PIB Succinimide dispersant. The results are shown in the table below, including further deposit measurement according to MTU Deposit test mtv5040, a standard test method described (DIN 51535).

| | Sample wt % actives | PIB Succinimide wt % actives | TEOST 33 (mg deposit) | MTU Deposit (mg) (measured twice) | Nitration (RONO2/C═O) | Seals T/S_Change % | Seals R/E_Change % |
|---|---|---|---|---|---|---|---|
| control 7 | — | 4.1 | 11.9 | 117/104 | 19.6/17.1 | −62 | −57 |
| Sample 9 | 2 | 2.1 | 16.3 | 66/71 | 20.1/20.5 | −51 | −51 |
| Sample 10 | 3 | 1.1 | 7.7 | 88/83 | 15.0/14.1 | −31 | −34 |
| Sample 10 | 2 | 2.1 | 13.4 | 85/97 | 17.2/17.5 | −44 | −66 |

Each of the documents referred to above is incorporated herein by reference. The mention of any document is not an admission that such document qualifies as prior art or constitutes the general knowledge of the skilled person in any jurisdiction. Except in the Examples, or where otherwise explicitly indicated, all numerical quantities in this description specifying amounts of materials, reaction conditions, molecular weights, number of carbon atoms, and the like, are to be understood as modified by the word "about." It is to be understood that the upper and lower amount, range, and ratio limits set forth herein may be independently combined. Similarly, the ranges and amounts for each element of the invention can be used together with ranges or amounts for any of the other elements. As used herein, the expression "consisting essentially of" permits the inclusion of substances that do not materially affect the basic and novel characteristics of the composition under consideration.

What is claimed is:

1. A dispersant composition comprising the reaction product of a polyolefin acylating agent, and a hydroxyl terminated polyether of either formula II Formula II

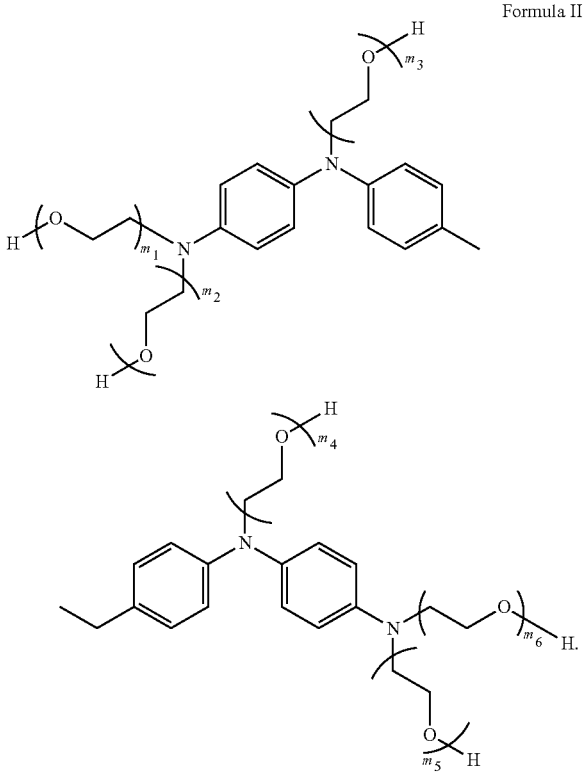

wherein each m individually is 0, 1, 2, 3 or 4, or formula III

Formula III

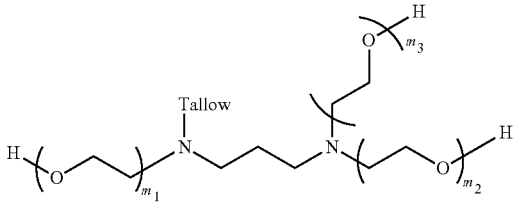

wherein each m individually is 0, 1, 2, 3, 4 or 5, wherein the polyether has a number average molecular weight of between about 100 and 1500.

2. The dispersant composition of claim 1 wherein the hydroxyl terminated or amine terminated polyether is selected from the group consisting of (i) a polyethylene glycol, (ii) a polypropylene glycol, (iii) a mixture of polyoxyalkylene amines, or (iv) some combination thereof.

3. The dispersant composition of claim 1 wherein the hydroxyl terminated or amine terminated polyether is selected from the group consisting of (i) triethylene glycol, (ii) diethylene glycol, (iii) a 250 to 350 molecular weight polyethylene glycol, (iv) a 200 to 350 molecular weight polytetrahydrofuran, (v) a mixture of one or more amine terminated glycols containing units derived from ethylene oxides, propylene oxides, butylene oxides or some combination thereof, or (vi) some combination thereof.

4. The dispersant composition of claim 1 wherein the polyolefin acylating agent is the reaction product of a polyolefin selected from polyisobutylene or an olefin-copolymer with a carboxylic acid selected from monoethylenically unsaturated $C_3$-$C_{28}$ monocarboxylic acid or ester thereof, or monoethylenically unsaturated $C_4$-$C_{28}$ dicarboxylic acid, anhydride or ester thereof.

5. The dispersant composition of claim 4 wherein the reaction is not free-radically initiated.

6. The dispersant composition of claim 4 wherein the carboxylic acid is maleic acid, itaconic acid, fumaric acid, and anhydrides or esters thereof.

7. The dispersant composition of claim 4, wherein the polyolefin has a number average molecular weight of between about 1000 and 15,000.

8. The dispersant composition of claim 1 wherein the reaction product further comprises a polyethylene polyamine.

9. A lubricant composition comprised of a dispersant composition according to claim 1, and an oil of lubricating viscosity.

10. The lubricant composition of claim 9 further comprising a PIB Succinimide.

11. A method of improving deposit performance in an engine comprising applying to the engine the composition of claim 9.

12. A method of improving nitration and oxidation performance in an engine oil comprising applying to the engine the composition of claim 9.

13. A method of improving seal performance in an engine comprising applying to the engine a composition as claimed in any of claim 9.

14. A method of maintaining TBN in an engine oil comprising applying to the engine oil a dispersant composition as claimed in claim 1.

15. The method of claim 14 further comprising applying to the engine oil a PIB Succinimide.

* * * * *